United States Patent [19]

Herman

[11] 4,325,063

[45] Apr. 13, 1982

[54] DISPLAY DEVICE WITH VARIABLE CAPACITY BUFFER MEMORY

[75] Inventor: Morton B. Herman, Queens Village, N.Y.

[73] Assignee: Redactron Corporation, Hauppauge, N.Y.

[21] Appl. No.: 47,625

[22] Filed: Jun. 11, 1979

Related U.S. Application Data

[63] Continuation of Ser. No. 851,818, Nov. 16, 1977, abandoned.

[51] Int. Cl.[3] ..... G09G 1/14

[52] U.S. Cl. ..... 340/750; 340/748; 340/790

[58] Field of Search ..... 340/748, 749, 750, 798, 340/799, 800, 801; 365/233

[56] References Cited

U.S. PATENT DOCUMENTS

| | | | |
|---|---|---|---|
| 3,351,929 | 11/1967 | Wagner | 340/703 |
| 3,582,936 | 6/1971 | Kite | 340/709 |
| 3,623,069 | 11/1971 | Malden | 340/748 |
| 3,671,957 | 6/1977 | Kegelman | 340/733 |
| 3,683,359 | 8/1972 | Kleinschnitz | 340/801 |
| 3,685,038 | 8/1972 | Flanagan | 340/703 |
| 3,737,890 | 6/1973 | Salava | 340/347 DD |
| 3,821,730 | 6/1974 | Carey et al. | 340/750 |
| 3,903,517 | 9/1975 | Hafner | 358/180 |
| 3,930,250 | 12/1975 | Blejwas | 340/799 |
| 3,952,297 | 4/1976 | Stauffer et al. | 340/798 |
| 3,974,493 | 8/1976 | de Cavaignac | 340/748 |
| 3,995,263 | 11/1976 | Shreve et al. | 340/750 |
| 4,117,469 | 12/1976 | Levine | 340/750 |

*Primary Examiner*—Marshall M. Curtis

*Attorney, Agent, or Firm*—Hane, Roberts, Spiecens & Cohen

[57] ABSTRACT

A display system which has a source of blocks of codes representing characters to be displayed and a display device which converts the blocks of codes to lines of visually displayed characters is provided with a buffer memory which connects the source to the display device. The buffer memory includes a random access memory (RAM) with addressed registers for storing the codes and an address generator in the form of a counter. When a block of codes is transferred from the source to the buffer memory, the counter is initialized and as each code is transmitted to the buffer memory the counter is incremented. Each time the block of codes is transferred from the buffer memory to the display device the counter is again initialized and with the reading of each code from the memory the counter is again incremented. The buffer memory includes two identical RAMs and is controlled such that while one RAM is being loaded the other RAM is being read.

6 Claims, 4 Drawing Figures

DISPLAY SYSTEM

DISPLAY SYSTEM

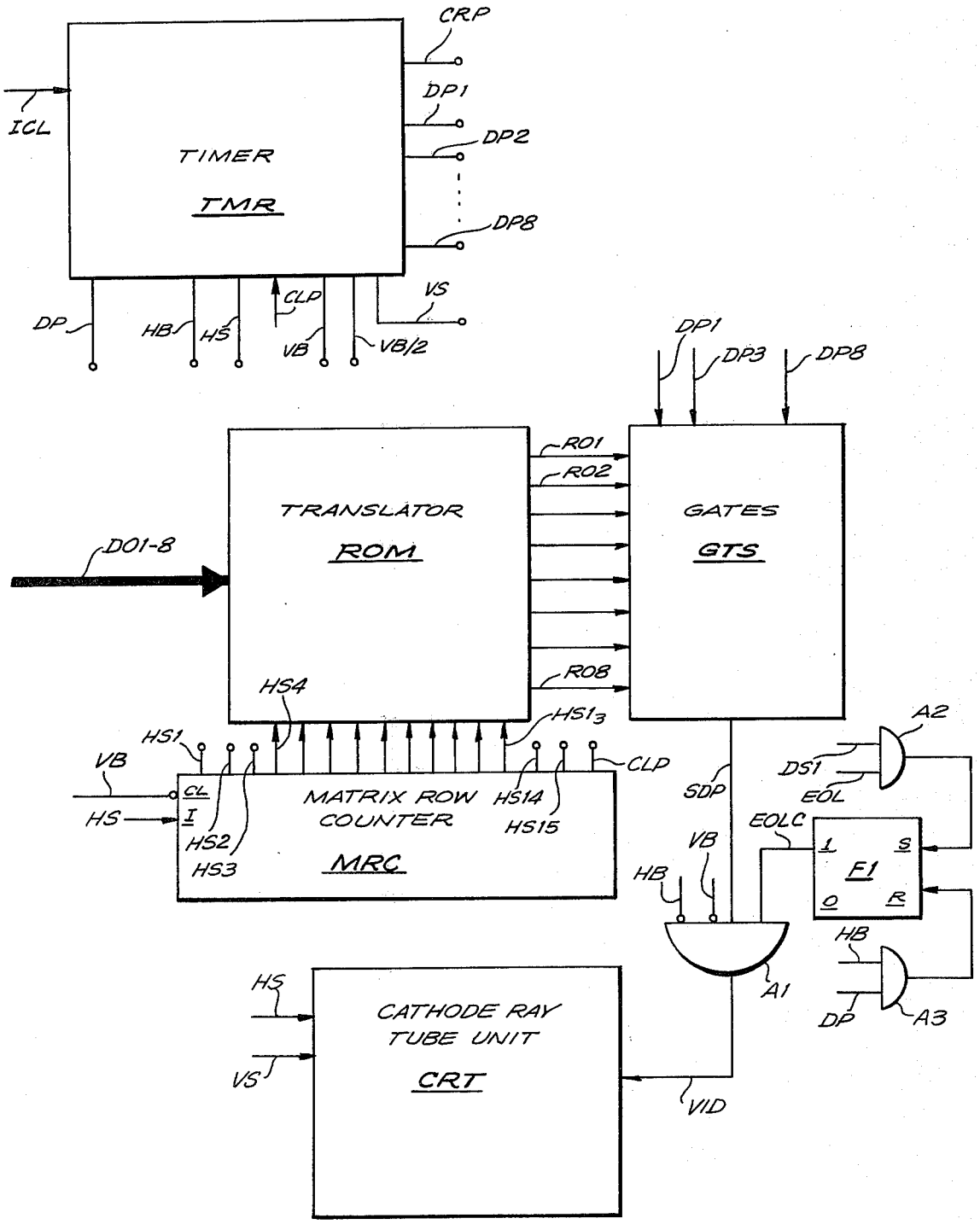
FIG. 2 DISPLAY DEVICE DIS

CONTROL UNIT CRT

VARIABLE LENGTH MEMORY UNIT VLMY

DISPLAY DEVICE WITH VARIABLE CAPACITY BUFFER MEMORY

This is a continuation of application Ser. No. 851,818 filed Nov. 16, 1977, now abandoned.

BACKGROUND OF THE INVENTION

This invention pertains to display systems and more particularly to those systems using display devices which must utilize the same data several times during the display operation.

The most common of such display devices are cathode ray tube (CTR) displays which need periodic refreshing. However, not only CRT displays but also ink jet and laser displays wherein the characters are formed by matrices of dots require receiving the data several times to form a line of characters. A typical such display device is shown in U.S. Pat. No. 3,754,229 wherein a data source feeds the codes (code combinations of bits) for a line of characters to an end-around shift register acting as a line memory, i.e., a memory storing the character codes associated with one line of display. The codes are fed from the shift register to a translator where they are converted to rows of dot signals which are fed to a CRT. During each circulation a different row of dot signals is generated for each character. Thus if the dot matrix is an m×n matrix, then there are n circulations of the data. Such a display system has limited flexibility.

If the number of characters to be displayed per line is a variable due to multiple pitch capability there may be some more cells in the line memory than are needed. For example, a 10 pitch display shows 72 characters and the proportional width display up to 123. If this memory were a shift register, then during the read out mode 51 shifts could be required in the horizontal retrace interval of the CRT to return to the head of the line. During, the write mode, i.e., filling the buffer, the device which transfers from the character source to the line memory need only transfer characters up to an End of Line Code (or equivalent) in the allotted time. The speed of transfer is dependent on available character source accesses because of the processing of flags and the discarding of Non-Display characters which may be embedded in the character streams. In using a shift register the constraints on loading time become severe as the entire register must be shifted in one screen line time (horizontal scan line time) to reposition to the first characters.

SUMMARY OF THE INVENTION

It it a general object of the invention to provide a display system including a buffer memory which simulates a variable length shift register.

Briefly the invention contemplates a display system having a character code source of coded combinations of bits representing characters, a display means for converting the coded combinations of bits into visually displayed characters, and buffer memory means interconnecting the character code source to the display means. The buffer memory means includes an addressed memory array having a plurality of addressed registers and an address counter means. A first source of incrementing signals feeds such signals to the buffer memory means to increment the address counter means and activate memory writing means each time a character code is emitted from the character code source. A second source of incrementing signals feeds such signals to the buffer memory means to increment the address counter means and activate memory reading means each time a character code is required by the display means. Initializing means clear the address counter means each time a set of coded combinations of bits is transferred from the character code source to the buffer memory means and also each time the set of coded combinations of bits is transferred from the buffer memory means to the display means.

BRIEF DESCRIPTION OF THE DRAWING

Other objects the features and advantages of the invention will be apparent from the following detailed description when read with the accompanying drawing which shows by way of example and not limitation the presently preferred embodiment of the invention. In the drawing:

FIG. 2 is a block diagram of the display device of the system of FIG. 1;

DESCRIPTION OF THE PREFERRED EMBODIMENT

Figure 1:
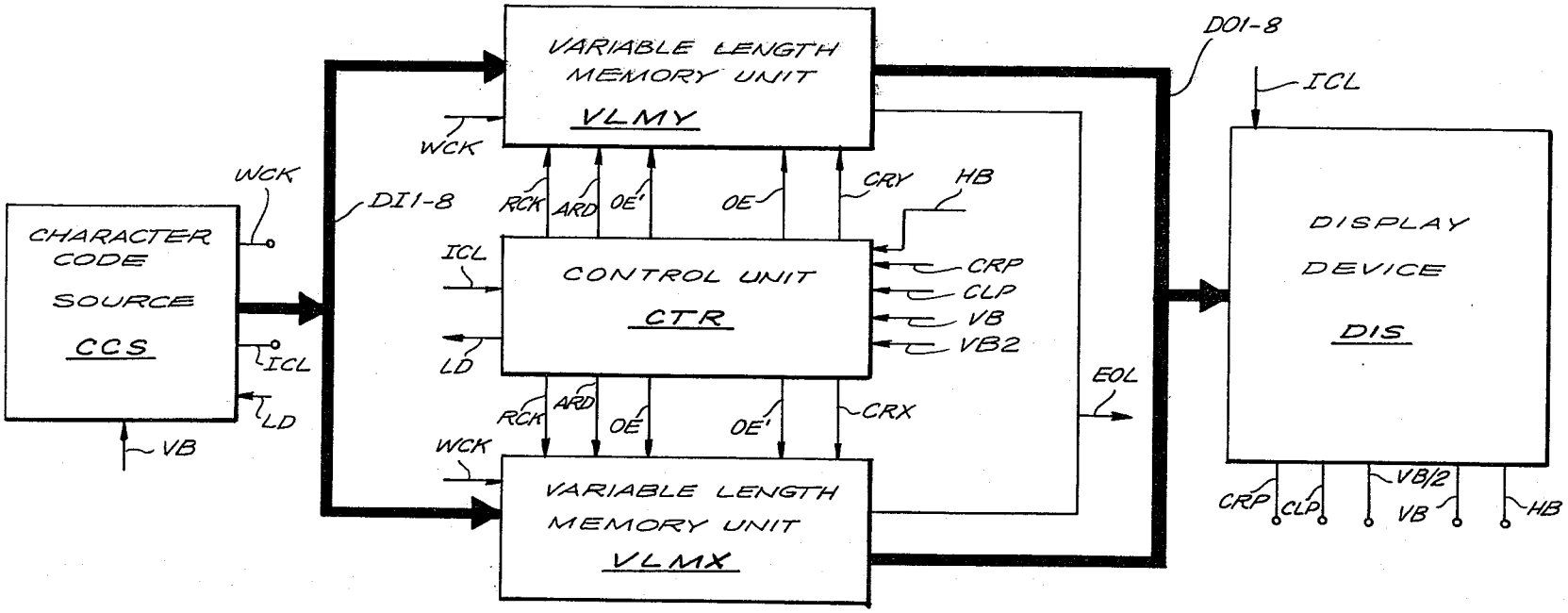
FIG. 1 is a block diagram of a display system in accordance with the invention.

In FIG. 1 the outputs of a character code source CCS are connected via the eight line cable DI1-8 to the inputs of variable length memory units VLMY and VLMX whose outputs are connected via eight line cable DO1-8 to display device DIS. Character source CCS can be a memory which stores blocks of character codes wherein each block or set contains the character codes for one line of text followed by an end of line code. For the present example, the character codes can be coded combinations of eight bits such as used in the ASCII code. Again, by way of example, it will be assumed that any one text line can contain up to 123 characters. Character code source CCS will deliver a block of characters in response to a signal on line LD by sequentially emitting the character codes and with each character code emitting a signal (strobe pulse) on line WCK. In addition, in response to each signal received on line LD character code source CCS will transmit a different block of character codes. By way of example, source CCS can be a page memory, i.e., a memory say storing by blocks 60 lines of text with each block stored in a different addressed field of the memory. The source can include an address counter which is field incremented in response to a signal of line LD and is initialized by the leading edge of the signal on line VB.

The display device DIS which is hereinafter more fully described can include: a CRT display which is driven in a conventional horizontal line raster scan; a timing signal generator which generates the signals for synchronizing the raster scan such as the horizontal and vertical blanking signals brought out on line HB and VB as well as signals indicating character timing on line CRP and text line timing on line CLP.

In addition, display device DIS includes a translator for converting the character codes to dot signals for modulating the beam of the CRT display.

The variable length memory units VLMY and VLMX are identical and include an addressed memory array in the form of a random access memory (RAM) which has 128 addressed registers each being able to store eight bits and an address counter which can be initialized, can be unit incremented, and which locks on a maximum count of 128 until reinitialized.

The control unit CTR basically receives timing signals from display device DIS and in response thereto feeds control signals to the variable length memory units VLMY and VLMX and to display device DIS.

In operation, after an initial clear signal on line ICL which initializes all counters and flipflops of the system to a starting state, display device DIS starts generating the raster for the CRT display. Halfway through a vertical blanking interval a signal is fed on line VB/2 to control unit CTR which in turn generates a signal on line OE, a signal on line CRY and a signal on line LD. The signal on line OE operatively connects the outputs of memory unit VLMX to cable DO1-8 and makes memory unit VLMY responsive to signals on line WCK. The signal on line CRY initializes the address counter in variable length memory unit VLMY to a count of one to address the first register of the RAM. The signal on line LD causes character code source CCS to start emitting serially the character codes on cable DI1-8 along with their strobe pulses on line WCK to variable length memory unit VLMY. (Note even though the cable DI1-8 and line WCK are connected to variable length memory unit VLMX the absence of a signal on line OE' thereto operatively disconnects this memory unit from the character code source CCS). The first character code is entered in the first register of the RAM while the trailing edge of the first strobe pulse increments the address counter to a count of two. The next character code is fed into the second addressed register while the strobe pulse therewith increments to address counter to a count of three. In this way the block of characters of the first text line are loaded into memory unit VLMY.

At the end of the vertical blanking interval as indicated by the end of a signal on line VB the control unit CTR becomes responsive to signals on line CLP which occur at the end of each text line. The first signal on line CLP after the end of vertical blanking causes control unit CTR to terminate the signal on line OE, to initiate a signal on line OE' and to generate a signal on line LD, a signal on line CRX, and a signal on line CRY. The effect of the changeover is to operatively connect the outputs of variable length memory unit VLMY to the lines of cable DO1-8 and operatively disconnect the outputs of the memory unit VLMX therefrom. At the same time, the signal on line CRX initializes the address counter in memory unit VLMX while the signal on line OE' makes this memory unit receptive to strobe pulses on line WCK. The signal on line LD causes character code source CCS to emit the second block of character codes on cable DI1-8 along with their associated strobe pulses on line WCK. The addressed memory array of memory unit VLMX is now loaded with the second block of character codes in the same manner as the addressed memory array of memory unit VLMY had been loaded with the first block of character codes.

At the same time, the signal on line CRY initialized the address counter of memory unit VLMY, the signal on line OE' made it responsive to increment and read signals on line RCK from control unit CTR in response to signals of line CRP from display device DIS. Note the address counter in memory unit VLMY is set to one so that the first signal on line RCK causes the contents of the first register of the addressed memory array therein to be read onto lines D01-8 while the trailing edge of the first signal increments the address counter to a count of two. The next signal on line RCK causes the reading out of the contents of the second addressed register and the unit incrementing of the address counter. In this way the contents of the memory unit VLMY are read out to display device DIS. It should be noted that because the display device DIS displays characters in dot matrix form each read out of a memory unit causes the generation of one row of dots. Thus the memory unit must be read out at least as many times as there are rows of dots in the matrix. In the present case, by way of example, there will be sixteen read outs per character line. After the first read out of a character line the remaining initializing pulses on line CRY are generated in response to signals on line HS.

At the end of read out this first text line as indicated by a signal on line CLP the states of the signals on lines OE and OE' interchange and the roles of the variable length memory units interchange. The contents of memory unit VLMX are read out to display unit DIS for display as the second line of text and a new block characters associated with the third line of text is read into memory unit VLMY. This procedure of interchanging continues until the end of the "page", i.e., after the bottom line of text is displayed. Then, the vertical blanking interval starts and the whole process is repeated.

If during the transfer of a block of character codes from a memory unit there is detected an end of line code a signal is transmitted on line EOL to the display unit DIS which shuts off the electron beam of the CRT device until the start of the next horizontal scan to insure that a clean display is presented for short lines.

The display device DIS as shown in FIG. 2 includes a timer TMR which performs the basic timing for the system. The timer TMR includes a free-running pulse generator which generates a stream of pulses on line DP which time the pixels. The pulses on line DP are modulo-ten counted to produce sequentially, the signals on lines CRP, DP1, DP2, . . . , DP8. The signals on line CRP are counted. During each cycle the eighty fourth initiates a signel on line HB, and gives a pulse on line HS, and the hundredth terminates the HB signal. The cycle then repeats. The HS signals are counted in matrix row counter MCR and each sixteenth gives a CLP signal which in turn is counted in timer TMR. In each counting system the sixtieth CLP signal initiates the vertical blanking signal on line VB and gives a pulse on line VS, the eightieth CLP signal generates a signal on line VB/2, and the hundredth CLP signal termiates the signal on line VB. It should be noted that these counting factors are representative and are subject to variation dependent on the sawtooth generator circuits of the CRT device.

The translator ROM can be a read only memory which is character addressed by signals on the eight lines of cable DO1-8. Each character address in effect selects ten eight-bit registers (assuming a character is represented by ten rows of eight dots). The actual row is selected by matrix row counter MRC. The counter MRC is a modulo sixteen counter and decoder which counts signals on line HS i.e., the beginning of the vertical blanking. Note the signals on lines HS1 to HS3 and HS14, HS15 and CLP are not used for selecting rows of dots but provide space above and below the displayed characters. The signals on lines HS4 to HS13 sequentially select rows of dots. When a row of dots of a particular character is selected they are fed in parallel on lines RO1 to RO8 to gates GTS. The gates GTS are a logic network solving the following Boolean equation $$SDP = RO1 \cdot DP1 + RO2 \cdot DP2 +, \ldots + RO7 \cdot DP7 + RO8 \cdot DP8.$$

(Note the signals on line CRP do not take part in the sampling so as to provide space between characters.)

The output of gates GTS is fed via line SDP to one input of AND-circuit A1. These dot signals will pass through the AND-circuit A1 during: the absence of a signal on line HB, i.e., not during horizontal blanking; the absence of a signal on line VB, i.e., not during vertical blanking; and during the absence of a signal on line EOLC, i.e., not during the end of a short text line.

The generation of the signal on line EOLC is controlled by flip-flop F1 which is set by the coincidence of signals on lines EOL and DS1 connected to inputs of AND-circuit A2 and reset by the coincidence of signals on lines DP and HB connected to inputs of AND-circuit A3.

The cathode ray tube unit CRT can be a conventional device which generates a horizontal line raster in response to signals on line HS and VS and whose electron beam is modulated by signals on line VID.

Figure 3:
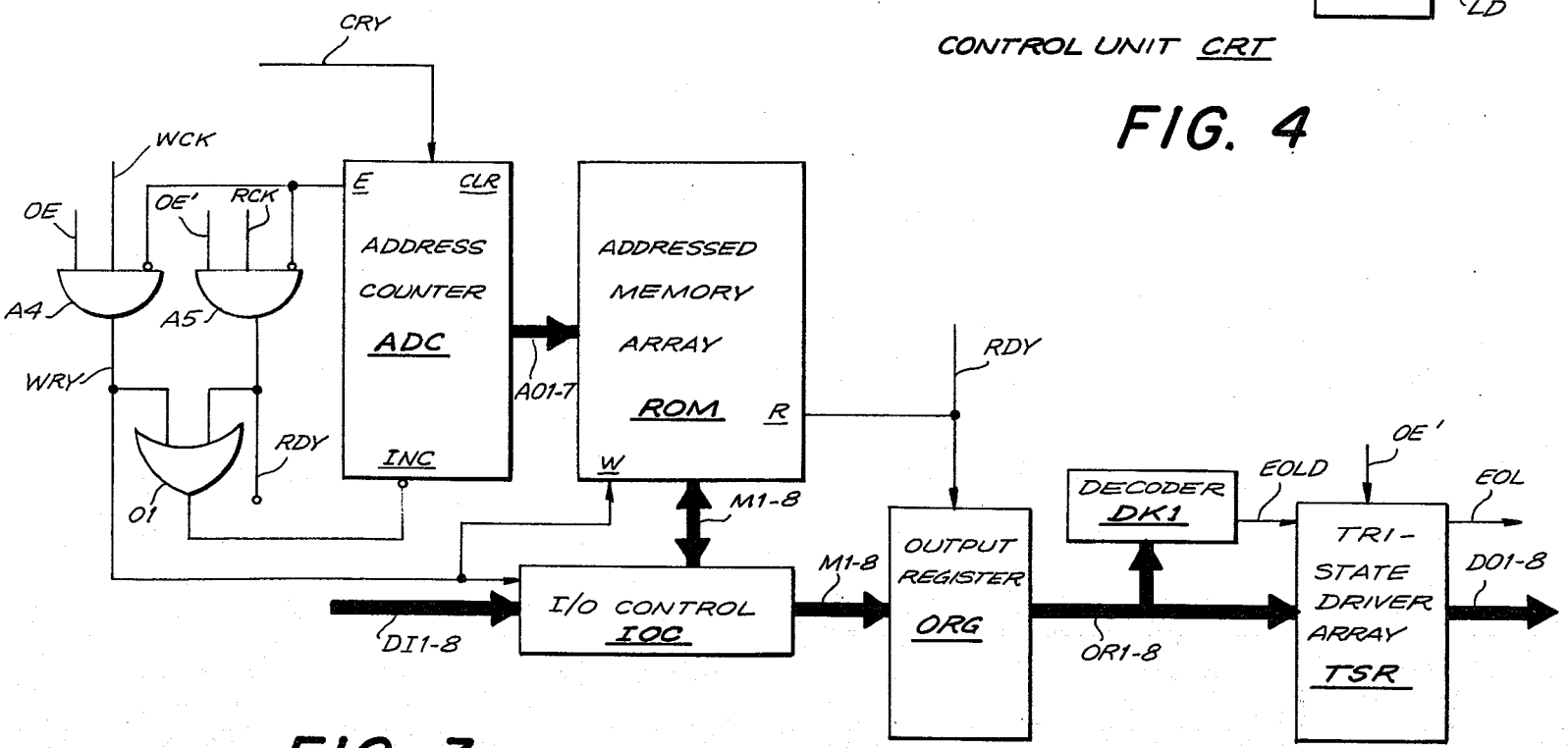
FIG. 3 is a block-and-logic diagram of one of the two variable length memory units of the system of FIG. 1.

The variable length memory unit VLMY shown in FIG. 3 centers around addressed memory array ROM which, for the example under consideration, can be a conventional random access memory having 128 eight-bit registers. The registers are selected by means of addresses on lines of cable AO1-7 from address counter ADC which can be a conventional up counter which counts to at least 128. The counter has an input CLR which whenever it receives a signal on line CRY clears the counter to a count of one and an output E which generates a signal when the count reaches 128. The counter is unit incremented at the trailing edge of any signal it receives from the output of OR-circuit O1 whose inputs are connected to lines RDX and WRY.

Line RDY which is connected to the output of AND-circuit A5 is pulsed whenever a character code is to be read from memory unit VLMY; and line WRY which is connected to the output of AND-circuit A4 is pulsed whenever a character is to be written into the memory unit VLMY.

The I/O buffer in the array ROM is connected to the eight lines of cable M1-8. I/O control unit IOC connects these lines to the corresponding lines of cable DI1-8 during the occurrence of a signal on line WRY. In particular, this control unit can be eight 2-input AND-circuits each having one input connected to line WRY and the other input to one of the lines of cable DI1-8. Thus whenever signals are present on lines WCK and OE, the character code then present on cable DI1-8 is read into the register of memory array ROM then being addressed by address counter ADC. At the end of the signal on line WRY counter ADC is unit incremented.

Output register ORG can be eight latches, each having an input connected to one of the lines of cable M1-8 and all being strobed by a signal on line RDY. Thus whenever signals are present on lines OE' and RCK, the character code in the register then being addressed by address counter ADC is loaded into the output register ORG. At the end of the signal in line RDY the address counter ADC is unit incremented.

The output of output register ORG is connected to the eight lines of cable OR1-8. A decoder DK1 which can be an eight-input AND-circuit having a coded combination of direct and inverting inputs has its inputs connected to line of cable OR1-8. The coding of the inputs is such that when the end of line code is present it emits a signal on line EOLD to tristate driver array TSR.

Tristate driver array TSR which can be nine two-input-tristate gates each having one input connected to line OE' and another input connected to one of the lines of cable OR1-8 or line EOLD. The outputs of the drivers of array TSR are connected to line EOL and the lines of cable DO1-8.

The memory unit VLMX is exactly the same except the connections to line OE and OE' are interchanges.

Figure 4:
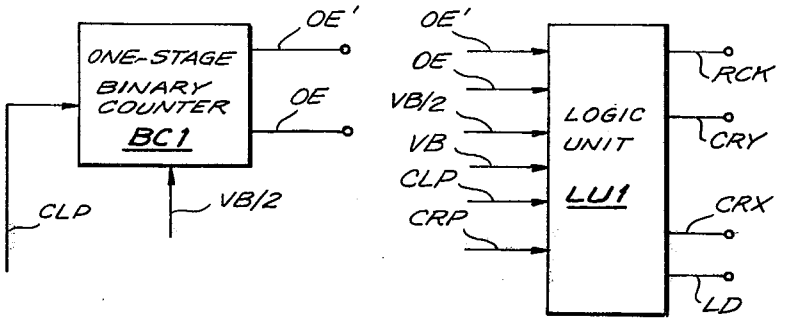
FIG. 4 is a logic diagram of the control unit of the system of FIG. 1.

The control unit shown in FIG. 4 comprises: the one stage binary counter BC1 which is forced to the state of generating a signel on line OE when it receives a signal on line VB/2 connected to its initializing input. Thereafter the counter switches state for each signal on line CLP connected to its toggle input; and the logic unit LU1. Logic unit LU1 can be a combination of AND-circuits, OR-circuits, and inverters which satisfy the following Boolean equations $$RCK = CRP \cdot VB' \cdot HB'$$

$$CRY = VB/2 + [VB' \cdot CLP] + [HS \cdot OE']$$

$$CRX = [VB' \cdot CLP] + [HS \cdot OE]$$

$$LD = [VB' \cdot CLP] + VB/2.$$

While only one embodiment of the invention has been shown and described in detail there will now be obvious to those skilled in the art many modifications and variations satisfying many or all of the objects of the invention.

What is claimed is:

1. A display system comprising: a character code source of coded combinations of bits representing characters; a first source of incrementing signals occurring each time a coded combination of bits is emitted by said character code source; a display means for visually displaying the characters represented by the coded combinations of bits; a second source of incrementing signals occurring each time said display means requires one of said coded combinations of bits; a first buffer memory means connecting said character code source to said display means and comprising an addressed memory array having a plurality of addressed storage registers, each of said storage registers being capable of storing one of said coded combinations of bits, and address counter means for generating the addresses of said addressed register, incrementing means for incrementing the count in said address counter means each time an incrementing signal is received from said first or second source, writing means responsive to each incrementing signal from said first source for writing a coded combination of bits from said character code source into an addressed register indicated by said address counter means, and reading means responsive to each incrementing signal from said second source for reading the coded combination bits stored in an addressed register indicated by said address counter means and transferring said coded combination of bits to said display means; second buffer memory means connecting said character code source to said display means and comprising an addressed memory array having a plurality of addressed storage registers, each of said storage registers being capable of storing one of said coded combinations of bits, and address counter means for generating the addresses of said addressed registers, incrementing means for incrementing the count in said address counter means each time an incrementing signal is received from said first or second source, writing means responsive to each incrementing signal from said first source for writing a coded combination of bits from said character code source into an addressed register indicated by said address counter means, and reading means responsive to each incrementing signal from said second source for reading the coded combination bits stored in an addressed register indicated by said address counter means and transferring said coded combination of bits to said display means; controlled initializing means for cleaning said address counter means each time a set of coded combination of bits is to be transferred to said buffer memory means and each time said set is to be transferred from said buffer memory means to said display means; means for controlling said initializing means to clear the address counter means of each of said buffer memory means; connecting means for alternately, first, operatively connecting said addressed memory array of said first buffer memory means to said character code source and operatively connecting said addressed memory array of said second buffer memory means to said display means, and, second, operatively connected said addressed memory array of second buffer memory means to said character code source and operatively connecting said addressed memory array of said first memory means to said display means; and means for feeding said first incrementing signals to the incrementing means and the writing means of the buffer memory means whose addressed memory array is operatively connected to said character code source and for feeding said second incrementing signals to the incrementing means and the reading means of the buffer memory means whose addressed memory array is operatively connected to said display means.

2. The display system of claim 1 wherein each set of coded combinations of bits written into said addressed registers is read therefrom a plurality of times and further comprising means for demanding from said character code source a new set of coded combinations of bits for storage by said addressed registers after the set stored therein has been read said plurality of times.

3. The display system of claim 1 further comprising means for disabling said incrementing means, said writing means and said reading means whenever the count in said address counter means exceeds a given count.

4. The display system of claim 1 further comprising means for preventing said display device from displaying any characters during the time from when a particular coded combination of bits is read from a register of said addressed memory array to the next occurring operation of said initializing means.

5. The display system of claim 1 wherein each set of coded combinations of bits written into said addressed registers is read therefrom a plurality of times and further comprising: means for demanding from said character code source a new set of coded combinations of bits for storage by said addressed registers after the set stored therein has been read said plurality of times; means for disabling said incrementing means, said writing means and said reading means whenever the count in said address counter means exceeds a given count; and means for preventing said display device from displaying any characters during the time from when a particular coded combination of bits is read from a register of said addressed memory array to the next occurring operation of said initializing means.

6. The display system of claim 5 wherein said connecting means includes first tristate gating means having an input connected to the addressed memory array of said first buffer memory means and an output, second tristate gating means having an input connected to the addressed memory array of said second buffer means and an output connected to the output of said first tristate gating means, and means for alternately activating said tristate gating means to pass coded combinations of bits to said display means.

* * * * *